US011658400B2

(12) United States Patent
Reichardt et al.

(10) Patent No.: US 11,658,400 B2
(45) Date of Patent: May 23, 2023

(54) ANTENNA-RETAINING DEVICE FOR A MOTOR VEHICLE, AND MOTOR VEHICLE HAVING AN ANTENNA-RETAINING DEVICE

(71) Applicant: AUDI AG, Ingolstadt (DE)

(72) Inventors: Lars Reichardt, Wettstetten (DE); Marcus Stech, Wolnzach (DE)

(73) Assignee: Audi AG, Ingolstadt (DE)

( * ) Notice: Subject to any disclaimer, the term of this patent is extended or adjusted under 35 U.S.C. 154(b) by 173 days.

(21) Appl. No.: 17/422,031

(22) PCT Filed: Dec. 11, 2019

(86) PCT No.: PCT/EP2019/084663
§ 371 (c)(1),
(2) Date: Jul. 9, 2021

(87) PCT Pub. No.: WO2020/156718
PCT Pub. Date: Aug. 6, 2020

(65) Prior Publication Data

US 2022/0102848 A1 Mar. 31, 2022

(30) Foreign Application Priority Data

Jan. 28, 2019 (DE) ..... 10 2019 201 029.6

(51) Int. Cl.
*H01Q 1/32* (2006.01)
*H01Q 1/12* (2006.01)
(Continued)

(52) U.S. Cl.
CPC ..... *H01Q 1/3283* (2013.01); *H01Q 1/1221* (2013.01); *H01Q 9/38* (2013.01); *H01Q 9/40* (2013.01)

(58) Field of Classification Search
CPC ..... H01Q 1/32; H01Q 1/3283; H01Q 1/12; H01Q 1/1221; H01Q 9/38; H01Q 9/40
See application file for complete search history.

(56) References Cited

U.S. PATENT DOCUMENTS 5,020,765 A 6/1991 Evans et al.
6,191,751 B1 2/2001 Johnson
(Continued)

FOREIGN PATENT DOCUMENTS

CN 208738418 U * 4/2019 ..... H01Q 1/32
DE 19636584 C1 3/1998
(Continued)

OTHER PUBLICATIONS

International Search Report and Written Opinion of the International Searching Authority directed to related International Patent Application No. PCT/EP2019/084663, dated Mar. 30, 2020, with attached English-language translation 17 pages.
(Continued)

*Primary Examiner* — Hoang V Nguyen
(74) *Attorney, Agent, or Firm* — Sterne, Kessler, Goldstein & Fox P.L.L.C.

(57) ABSTRACT

The disclosure relates to an antenna-retaining device for a motor vehicle. The antenna-retaining device includes an antenna carrier plate for retaining a monopole antenna in an emitting position; and a motor-vehicle coupling device for fastening the antenna carrier plate to a vehicle body. The antenna carrier plate is electrically conductive and thus forms an electrical counterpoise to the monopole antenna. The antenna-retaining device includes an electrically conductive tab element as a counterpoise extension. The antenna carrier plate and the counterpoise extension are interconnected. When the monopole antenna is retained in the emitting position, the monopole antenna and the counterpoise extension are arranged on opposite sides of the antenna carrier plate, and a surface of the counterpoise extension and a planar emitting region or a longitudinal axis of the monopole antenna include an angle in the range of 90° to 180°.

19 Claims, 1 Drawing Sheet

(51) Int. Cl.
*H01Q 9/38* (2006.01)
*H01Q 9/40* (2006.01)

(56) References Cited

U.S. PATENT DOCUMENTS

| | | | | |
|---|---|---|---|---|
| 2010/0177003 | A1 | 7/2010 | Bashir | |
| 2013/0176182 | A1* | 7/2013 | Stolz | B23P 19/00 29/428 |
| 2016/0164190 | A1 | 6/2016 | Daurer et al. | |
| 2017/0288302 | A1 | 10/2017 | Silva et al. | |

FOREIGN PATENT DOCUMENTS

| | | | |
|---|---|---|---|
| DE | 19924349 | A1 | 12/2000 |
| DE | 102009005045 | A1 | 7/2010 |
| DE | 102015225756 | A1 | 6/2016 |
| FR | 2742584 | A1 | 6/1997 |
| WO | WO 2012/124756 | A1 | 9/2012 |

OTHER PUBLICATIONS

International Preliminary Report on Patentability directed to related International Patent Application No. PCT/EP2019/084663, dated Jul. 2, 2020, with attached English-language translation; 14 pages.

* cited by examiner

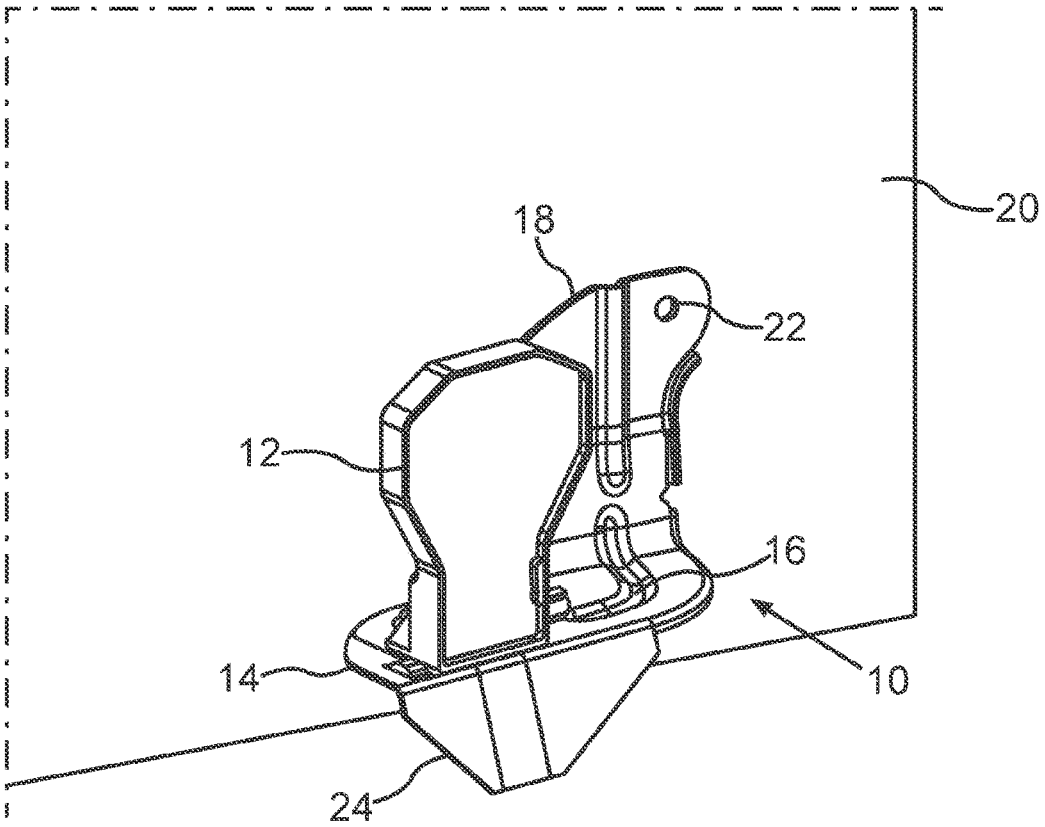
20
18
22
12
16
14
10
24

ANTENNA-RETAINING DEVICE FOR A MOTOR VEHICLE, AND MOTOR VEHICLE HAVING AN ANTENNA-RETAINING DEVICE

TECHNICAL FIELD

The disclosure relates to an antenna-retaining device for a motor vehicle, and a motor vehicle having an antenna-retaining device.

BACKGROUND

An antenna, in particular a monopole antenna, which is also referred to as a quarter-wave emitter, can be installed in a motor vehicle in the bumper region. For this purpose, the monopole antenna is typically positioned on a retainer of an antenna-retaining device and mounted on the bodyshell of the motor vehicle. The antenna-retaining device can serve as an electrical counterpoise for the monopole antenna and at the same time place the monopole antenna in a suitable space. The antenna-retaining device should ensure a distance to other components for electromagnetic compatibility.

DE 10 2015 225 756 A1 discloses an antenna for a vehicle having a carrier, antenna structures for transmitting and/or receiving high-frequency signals being arranged on the carrier.

DE 196 36 584 C1 discloses a bumper which is designed to accommodate an antenna arrangement.

DE 199 24 349 A1 discloses a mobile antenna which comprises a circularly polarized antenna which is arranged above a vertically polarized antenna on a remaining counterpoise surface. Parasitic emitter or balancing elements are provided on the remaining counterpoise surface, which protrude beyond the edge of the remaining counterpoise surface.

The antenna-retaining device usually results in a compromise between a space requirement and a requirement as an electrical counterpoise for the monopole antenna. This can result in detuning of the usable frequency of the monopole antenna due to the distance and structure of the surrounding conductive components.

BRIEF DESCRIPTION OF THE DRAWINGS/FIGURES

FIG. 1 shows a schematic perspective view of an antenna-retaining device, in accordance with some embodiments of the present disclosure.

DETAILED DESCRIPTION

The disclosure is based on the object of improving the transmission behavior of a monopole antenna.

The object is achieved by the subject matter of the independent claims. Advantageous developments of the disclosure are disclosed by the dependent claims, the subsequent description, and the drawings.

The disclosure is based on the knowledge that a tab-shaped extension of the electrical counterpoise in an opposite spatial direction to a monopole antenna improves a transmission behavior of the monopole antenna.

The disclosure provides an antenna-retaining device for a motor vehicle. The antenna-retaining device comprises an antenna carrier plate for retaining a monopole antenna in an emitting position and a motor-vehicle coupling device for fastening the antenna carrier plate to a vehicle body. In the emitting position, a distance exists between the retained monopole antenna and the vehicle body. The antenna carrier plate is electrically conductive and thus forms an electrical counterpoise to the monopole antenna. In other words, the antenna-retaining device comprises an antenna carrier plate which can retain a monopole antenna at a distance from a vehicle body, and a motor-vehicle coupling device in order to mount the antenna carrier plate on the vehicle body. In this case, the antenna carrier plate can be electrically conductive, for example by being made of sheet steel in order to form an electrical counterpoise, i.e. a ground connection, to the monopole antenna, which is also referred to as a ground plane antenna.

According to some embodiments of the present disclosure, the antenna-retaining device comprises an electrically conductive tab element as a counterpoise extension, wherein the antenna carrier plate and the counterpoise extension are interconnected, wherein, when the monopole antenna is retained in the emitting position, the monopole antenna and the counterpoise extension are arranged on opposite sides of the antenna carrier plate, and a surface of the counterpoise extension and a planar emitting region or a longitudinal axis of the monopole antenna include an angle in the range of 90 degrees to 180 degrees.

In other words, an electrically conductive tab element is provided as a counterpoise extension for the antenna-retaining device, which is connected to the antenna carrier plate, the antenna carrier plate being arranged on an opposite side to a monopole antenna retained in the emitting position. This means that if, for example, the monopole antenna is retained on an upper side of the antenna carrier plate, the counterpoise extension is arranged on an underside of the antenna carrier plate and vice versa. An angle in the range of 90 to 180 degrees is provided between the surface of the counterpoise extension and the monopole antenna. The electrically conductive tab element as a counterpoise extension can, for example, have a round, square or triangular shape, or comprise a combination of a plurality of geometric figures, such as a combination of a rectangle and a trapezoid. The counterpoise extension can be screwed or welded to the antenna carrier plate, for example. The angle in the range of 90 to 180 degrees can, for example, like the shape of the counterpoise extension, be adapted to an installation space of the antenna-retaining device, so that the antenna-retaining device can be adapted in accordance with an available space. In some embodiments, the length of the counterpoise extension can have a length of the monopole antenna and the angle between the monopole antenna and the surface of the counterpoise extension can be 180 degrees, so that the counterpoise extension generates a dipole antenna from the quarter-wave emitter of the monopole antenna. The disclosure results in the advantage that a possible detuning of a usable frequency can be compensated, so that a transmission behavior of the monopole antenna is improved, and that a space requirement of the antenna-retaining device can be set according to the available space, i.e. an installation space specific to the vehicle.

In some embodiments, slots can be provided on the counterpoise extension. The slots can be used, for example, to attenuate or filter out specific frequencies of the monopole antenna. For example, legal requirements can provide a maximum intensity for specific frequency ranges at specific spatial positions. In the case of slots in the counterpoise extension, it can be achieved that an intensity of a predetermined radio frequency in a spatial position of an emission direction of the monopole antenna is below a threshold value, the threshold value being possibly a legal requirement. This embodiment results in the advantage that power and intensity specifications can be complied with for predetermined radio frequencies.

In some embodiments, the antenna carrier plate can have a stiffening rib. The stiffening rib can be a channel-shaped depression in the antenna carrier plate, which can increase the rigidity and flexural strength of the antenna carrier plate. However, this stiffening rib can also be designed as an elevation which is attached to an upper or lower side of the antenna carrier plate.

The disclosure also includes further embodiments, which offer additional advantages.

In some embodiments, the antenna carrier plate and the counterpoise extension can be made from the same electrically conductive material. Steel or aluminum, for example, can be provided as the electrically conductive material. This embodiment results in the advantage that a usable frequency of a monopole antenna can be set in an improved manner, since no interference frequencies occur which can occur as a result of an interaction with different materials.

In some embodiments, the angle can be in a range of 135 degrees to 170 degrees. This means that the angle between the monopole antenna and the surface of the counterpoise extension is in the range of 135 to 170 degrees. A suitable setting of the usable frequency can be made in this angular range and the counterpoise extension can be suitably adapted to the installation space specific to the vehicle.

In some embodiments, a length of the counterpoise extension corresponds to a length of the monopole antenna or comprises at least 20 percent and at most 120 percent of the length of the monopole antenna. For example, a width of the counterpoise extension can also correspond to at least one width of the monopole antenna. This embodiment results in the advantage that a dipole can be generated in the case of a length of the counterpoise extension that corresponds to a length of the monopole antenna. Alternatively, however, the length of the counterpoise extension can be at least 20 percent of the monopole antenna, since a significant improvement in the usable frequency can be ascertained from this length, and at most 120 percent of the length of the counterpoise extension, since from this length a space requirement in a vehicle becomes too high.

In some embodiments, the counterpoise extension can have a trapezoidal basic shape. This means that a base area, or base, of the counterpoise extension, which is connected to the antenna carrier plate, has a greater length than the area running parallel thereto at a tip of the trapezoid. In particular, a trapezoidal basic shape means that an area difference between the trapezoidal basic shape and a geometric trapezoid can amount to a maximum of 20 percent. This embodiment results in the advantage that material can be saved and, in addition, side lobes of the emission characteristic of the monopole antenna can be attenuated.

In some embodiments, the antenna carrier plate and the counterpoise extension can be reversibly interconnected or can be formed in one piece. A reversible connection of the antenna carrier plate and the counterpoise extension can be realized, for example, by means of a screw connection. The advantage of this is that the counterpoise extension can be readjusted and, for example, when the location of the antenna-retaining device is changed, it can be adapted to the new space requirement in the installation space. A one-piece design of the antenna carrier plate and the counterpoise extension can be implemented, for example, by means of a stamped and bent part. This results in the advantage that costs can be saved in production.

In some embodiments, the motor-vehicle coupling device can have screw holes in order to fasten the antenna carrier plate to a vehicle body. For example, an angle element with screw holes can be used as a motor-vehicle coupling device with which the antenna carrier plate can be attached to the vehicle body. This results in the advantage that the antenna carrier plate can be fastened to the vehicle body in a cost-effective, reversible, and non-destructive manner.

According to the disclosure, a motor vehicle having an antenna-retaining device according to one of the embodiments is also provided. The motor vehicle according to the disclosure is preferably designed as a car, in particular as a passenger car or a truck or as a passenger bus.

The disclosure also comprises the combinations of the features of the described embodiments.

The embodiments explained in the following are preferred embodiments of the disclosure. In the embodiments, the described components of the embodiments each represent individual features of the disclosure which are to be considered to be independent of one another and which each further develop the disclosure independently of one another. Therefore, the disclosure shall also comprise other combinations of the features of the embodiments than the ones presented. Furthermore, the described embodiments may also be supplemented by further features of the disclosure as already described.

FIG. 1 shows a schematic perspective view of an antenna-retaining device 10 in accordance with one embodiment. A monopole antenna 12, which is retained by an antenna carrier plate 14, can be provided on the antenna-retaining device 10. The antenna carrier plate 14 can have one or more stiffening ribs 16 in order to increase the rigidity of the antenna carrier plate 14 and thereby, for example, reduce vibrations of the antenna carrier plate 14. Furthermore, the antenna carrier plate 14 can be fastened to a vehicle body 20 by means of a motor-vehicle coupling device 18. For this purpose, for example, screw holes 22 can be present in the motor-vehicle coupling device 18 in order to mount the motor-vehicle coupling device 18 on the vehicle body 20.

The antenna carrier plate 14 can be made of an electrically conductive material, such as steel or aluminum, in order to form an electrical counterpoise to the monopole antenna. In addition, in order to improve the usable frequency of the monopole antenna, an electrically conductive tab element can be connected to the antenna carrier plate 14 as a counterpoise extension 24. The counterpoise extension 24 can preferably be connected reversibly to the antenna carrier plate 14 by, for example, inserting a bolt through a connecting space between the antenna carrier plate 14 and the counterpoise extension 24, which is then screwed. Alternatively, however, the antenna carrier plate 14 and the counterpoise extension 24 can be formed in one piece, for example as a stamped and bent part.

The counterpoise extension 24 can be made of the same electrically conductive material as the antenna carrier plate 14, so that no frequency shifts occur due to different materials of the electrical counterpoise. In addition, the counterpoise extension 24 can be attached to a side of the antenna carrier plate 14 that is opposite the monopole antenna 12, and an angle between the monopole antenna and the counterpoise extension 24 includes an angle in the range of 90 to 180 degrees.

The counterpoise extension 24 can have a trapezoidal basic shape, the legs of the trapezoid tapering towards the tip and the center of the upper side of the trapezoid being at the level of the monopole antenna. This can ensure that a main lobe of the emission is reinforced by the counterpoise extension 24 and side lobes that can be emitted in the leg region of the trapezoidal basic shape of the counterpoise extension 24 are reduced. Hereby, an improvement of the usable frequency can be achieved.

The length of the counterpoise extension, i.e. the height of the trapezoid, can preferably correspond to a length of the monopole antenna, but it can also be the case that installation space in the motor vehicle is limited and therefore the counterpoise extension 24 has a reduced length and/or an adapted angle.

For example, the antenna-retaining device 10 can be mounted above an exhaust system (not shown) of the motor vehicle, so that installation space for the antenna-retaining device 10 can be limited. The counterpoise extension 24 can preferably be formed in a length range of at least 20 percent to at most 120 percent of the length of the monopole antenna and the angle between the surface of the counterpoise extension and the monopole antenna can be formed in a range of 135 degrees to 170 degrees. In this way, the usable frequency can be retuned and thus the monopole antenna 12 can be matched to the installation space specific to the vehicle.

In addition, the counterpoise extension can have slots (not shown) in order to dampen specific frequencies. Depending on the shape and the length of the slots, it can be achieved, for example, that only one power is output in one spatial direction that complies with legal requirements. Without the slots, for example, a reflector effect of the vehicle body 20 could result in an increased intensity value in the spatial direction, which can be avoided by the slots in the counterpoise extension 24.

Overall, the examples show how the disclosure can provide a retainer concept for tuning the usable frequency of an antenna.

The invention claimed is:

1. An antenna-retaining device of a motor vehicle for retaining a monopole antenna in an emitting position, comprising:
- an antenna carrier plate comprising a stiffening rib to reduce vibrations of the antenna carrier plate;
- a motor-vehicle coupling device configured to fasten the antenna carrier plate to a vehicle body, wherein:
  - the vehicle body is distant from the monopole antenna retained in the emitting position; and
  - the antenna carrier plate is electrically conductive and forms an electrical counterpoise to the monopole antenna; and
- a counterpoise extension comprising a slot and an electrically conductive tab element, wherein:
  - the counterpoise extension is interconnected with the antenna carrier plate;
  - the counterpoise extension and the monopole antenna are arranged on opposite sides of the antenna carrier plate; and
  - an angle between a surface of the counterpoise extension and a planar emitting region or a longitudinal axis of the monopole antenna is in a range between 90° to 180°.

2. The antenna-retaining device of claim 1, wherein the antenna carrier plate and the counterpoise extension are made from a same electrically conductive material.

3. The antenna-retaining device of claim 1, wherein the angle is in a range between 135° to 170°.

4. The antenna-retaining device of claim 1, wherein a length of the counterpoise extension corresponds to a length of the monopole antenna.

5. The antenna-retaining device of claim 4, wherein the length of the counterpoise extension comprises at least 20% and at most 120% of the length of the monopole antenna.

6. The antenna-retaining device of claim 1, wherein the counterpoise extension comprises a trapezoidal basic shape.

7. The antenna-retaining device of claim 1, wherein the antenna carrier plate and the counterpoise extension are reversibly interconnected.

8. The antenna-retaining device of claim 1, wherein the antenna carrier plate and the counterpoise extension are formed in one piece.

9. The antenna-retaining device of claim 1, wherein the motor-vehicle coupling device comprises screw holes to fasten the antenna carrier plate to the vehicle body.

10. A system of a motor vehicle, comprising:
- a monopole antenna; and
- an antenna-retaining device configured to retain the monopole antenna in an emitting position, comprising:
  - an antenna carrier plate comprising a stiffening rib to reduce vibrations of the antenna carrier plate;
  - a motor-vehicle coupling device configured to fasten the antenna carrier plate to a vehicle body, wherein:
    - the vehicle body is distant from the monopole antenna retained in the emitting position; and
    - the antenna carrier plate is electrically conductive and forms an electrical counterpoise to the monopole antenna; and
  - a counterpoise extension comprising a slot and an electrically conductive tab element, wherein:
    - the counterpoise extension is interconnected with the antenna carrier plate;
    - the counterpoise extension and the monopole antenna are arranged on opposite sides of the antenna carrier plate; and
    - an angle between a surface of the counterpoise extension and a planar emitting region or a longitudinal axis of the monopole antenna is in a range between 90° to 180°.

11. The system of claim 10, wherein the antenna carrier plate and the counterpoise extension are made from a same electrically conductive material.

12. The system of claim 10, wherein the angle is in a range between 135° to 170°.

13. The system of claim 10, wherein a length of the counterpoise extension corresponds to a length of the monopole antenna.

14. The system of claim 13, wherein the length of the counterpoise extension comprises at least 20% and at most 120% of the length of the monopole antenna.

15. The system of claim 10, wherein the counterpoise extension comprises a trapezoidal basic shape.

16. The system of claim 10, wherein the antenna carrier plate and the counterpoise extension are reversibly interconnected.

17. The system of claim 10, wherein the antenna carrier plate and the counterpoise extension are formed in one piece.

18. The system of claim 10, wherein the motor-vehicle coupling device comprises screw holes to fasten the antenna carrier plate to the vehicle body.

19. A motor vehicle, comprising:
- a monopole antenna; and
- an antenna-retaining device configured to retain the monopole antenna in an emitting position, comprising:
  - an antenna carrier plate comprising a stiffening rib to reduce vibrations of the antenna carrier plate;

a motor-vehicle coupling device for fastening the antenna carrier plate to a vehicle body, wherein:

the vehicle body is distant from the monopole antenna retained in the emitting position; and the antenna carrier plate is electrically conductive and forms an electrical counterpoise to the monopole antenna; and a counterpoise extension comprising a slot and an electrically conductive tab element, wherein:

the counterpoise extension is interconnected with the antenna carrier plate;

the counterpoise extension and the monopole antenna are arranged on opposite sides of the antenna carrier plate; and an angle between a surface of the counterpoise extension and a planar emitting region or a longitudinal axis of the monopole antenna is in a range between 90° to 180°.

* * * * *